US005483719A

United States Patent [19]

Ikemoto et al.

[11] Patent Number: 5,483,719

[45] Date of Patent: Jan. 16, 1996

[54] HAIR BRUSH WITH POROUS POLYTETRAFLUOROETHYLENE BODY

[75] Inventors: Chikahide Ikemoto, Higashi-Osaka; Yoshiyuki Ishibashi, Osaka, both of Japan

[73] Assignee: Ikemoto Brush Industries Co., Ltd., Osaka, Japan

[21] Appl. No.: 257,435

[22] Filed: Jun. 8, 1994

Related U.S. Application Data

[63] Continuation-in-part of Ser. No. 148,501, Nov. 8, 1993, abandoned.

[30] Foreign Application Priority Data

Apr. 23, 1991 [JP] Japan ..... 3-58966

[51] Int. Cl.[6] ..... A45D 44/18; A45D 24/16; B08B 1/00

[52] U.S. Cl. ..... 15/104.94; 15/104.93; 15/160; 132/112; 401/16; 401/24; 401/283; 401/138

[58] Field of Search ..... 15/104.94, 104.93, 15/104.92, 160; 132/108–116, 320, 202, 203, 204, 205, 208; 401/23, 24, 16, 25, 138, 139, 268, 282, 283; 252/12.2

[56] References Cited

U.S. PATENT DOCUMENTS

| | | | |
|---|---|---|---|
| 2,922,425 | 1/1960 | Lerner et al. | 132/108 |
| 3,447,181 | 6/1969 | Coker et al. | 15/104.94 |
| 3,833,008 | 9/1974 | Blackett, Jr. | 132/85 |
| 4,175,642 | 11/1979 | Bianchi et al. | 252/12.2 |
| 5,261,426 | 11/1993 | Kellet et al. | 15/104.93 |

FOREIGN PATENT DOCUMENTS

| | | | |
|---|---|---|---|
| 1229270 | 3/1960 | France | 15/104.94 |
| 590971 | 8/1947 | United Kingdom | 132/108 |

*Primary Examiner*—Gary K. Graham
*Attorney, Agent, or Firm*—Sixbey, Friedman Leedom & Ferguson; David S. Safran

[57] ABSTRACT

A hair brush comprises a brush main body, bristles vertically provided on the upper surface of the brush main body and an immersion member provided on the upper surface of the brush main body and immersed with a liquid substance to be coated to hair. As the immersion member, mentioned are a porous member in a form of a rod, a net formed by non-woven fabric or knitted fabric of porous fiber, or a member in a form of a plate formed by porous rubber.

18 Claims, 3 Drawing Sheets

HAIR BRUSH WITH POROUS POLYTETRAFLUOROETHYLENE BODY

This application is a Continuation-In-Part of Ser. No. 08/148,501, filed Nov. 8, 1993, now abandoned.

BACKGROUND OF THE INVENTION

1. Field of the Invention

This invention relates to a hair brush provided with a coating member for coating a liquid substance to hair.

2. Description of the Prior Art

There is occasionally occurred a case in which a liquid substance is coated on hair and brushing is applied to hair.

For example, there are some cases that split hair preventive (for example, silicone) is sprayed to hair in order to prevent split hair, hair dye agent is applied to hair in order to dye gray hair and hair liquid is applied to hair in order to adjust hair.

In the foresaid cases, when brushing is carried out while liquid substances such as split hair preventive, hair dye and hair liquid are being coated to hair, the hair brush must be held with one hand to perform brushing while a container such as a spray container or a bottle for storing the liquid substances is being held with the other hand to effect the coating to hair, and this operation is troublesome. In addition, in the case that these containers are large in size to cause inconvenience in carrying them, resulting in that in particular, when a short distance trip is to be taken, it is necessary to pour these substances from the large-sized containers into a small-sized one.

Further, direct coating of the liquid substance to hair from the container such as a bottle and the like causes the coated state of the liquid substance to be nonuniform, so that the substance is occasionally coated to hair after being applied to hand. In this case, hand is stained therewith, so that the hand must be washed with soap after coating. In addition, in the case that a coating is manually effected, coated amount for hair portions which the hand initially contacts is apt to be increased, resulting in that nonuniformly coated state is not so eliminated as expected.

In Unexamined Japanese Utility Model Publication HEI 1-154830 is proposed a coating tool provided with a cylinder for holding a liquid substance in order to solve the aforesaid problem, wherein the liquid substance in the cylinder is discharged by proper amount through capillary phenomenon caused by a bundle of fiber cores applied to an extremity end of the coating tool. Although use of such coating tool as described above enables the liquid substance to be uniformly coated without contaminating the hand, in the case that coating of the substance and brushing are concurrently performed, the coating tool is held with one hand and the brush is required to be held with the other hand.

SUMMARY OF THE INVENTION

It is an object of the present invention to provide a hair brush in which brushing and coating of a liquid substance can be concurrently carried out even if a container storing the liquid substance therein is not held by one hand in the case that the liquid substance such as split hair preventive or the like is coated to hair and brushing operation is carried out, and further in which the hand is not contaminated during coating and the coating can be uniformly performed.

That is, the hair brush of the present invention comprises a brush main body, bristles vertically provided on the upper surface of the brush main body and an immersion member provided on the upper surface of the brush main body and immersed with a liquid substance to be coated to hair.

The immersion member is attached to the surface of the brush main body. The immersion member can be changed.

The immersion member is a porous member in a form of a rod. A recess is provided on a central portion of the upper surface of the brush main body and the porous member in a form of a rod is removably attached to the recess.

The immersion member is a net formed by non-woven fabric or knitted fabric of porous fibers and the net covers the upper surface of the brush main body. Alternatively, the immersion member is a member in a form of a plate formed by porous rubber and the member in a form of a plate covers the upper surface of the brush main body.

Since the hair brush of the present invention is provided with the immersion member immersed with the liquid substance to be coated, when brushing is carried out, the brush is held with one hand and it is not necessary for the other hand to hold the container storing the liquid substance therein. In the case that the hair brush is applied for brushing, the liquid substance is percolated out of the immersion member to adhere to hair, the substance which is adhered to hair by bristles is uniformly coated. Accordingly, when coating is effected, hands are not contaminated with oil and the substance can be uniformly coated. If the hair brush having the liquid substance immersed therein is carried, it is not necessary to carry a large sized bottle containing the liquid substance therein and this is convenience in use.

DESCRIPTION OF THE PREFERRED EMBODIMENTS

Figure 1:
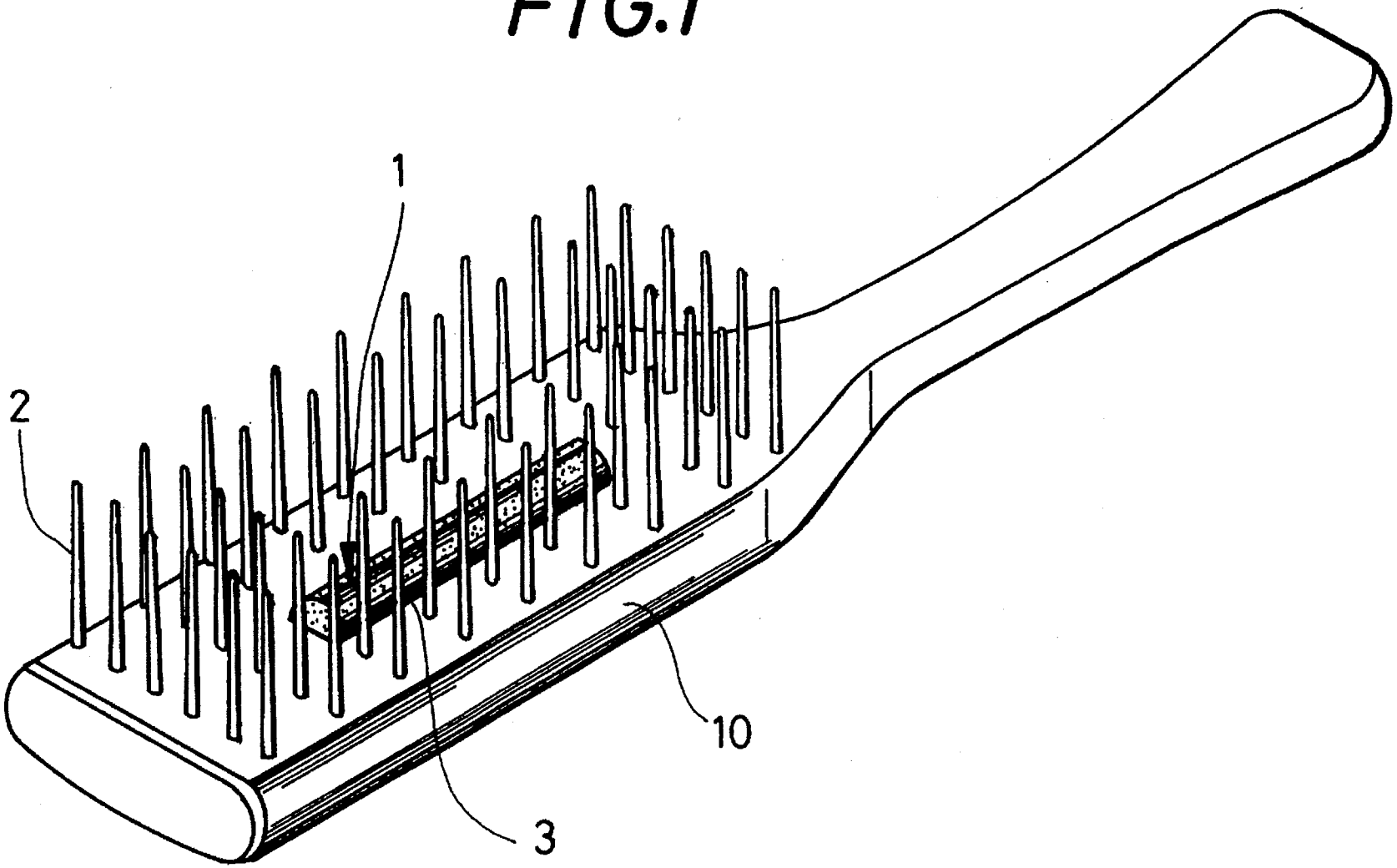
FIG. 1 is a perspective view showing a hair brush of an embodiment of the present invention.

Referring now to the drawings, some preferred embodiments of the present invention will be described.

A hair brush shown in FIG. 1 is made such that bristles 2 are vertically provided on the upper surface of brush main body 10 and an immersion member 1 is removably pressed into a recess 3 provided on the central portion of the upper surface of the brush main body 10. The immersion member 1 is immersed with a liquid substance to be coated on hair.

The hair brush shown in FIG. 1 is an example in which as the immersion member 1, Porefleonrod (product name) produced by Sumitomo Electrical Industries Limited which is made of tetrafluoroethylene resin, its size is 7×12×70 mm and the porosity of 80% of a porous member in a form of a rod. The holes are of continuous air bubbles at a part of or the entirety of the member in a form of a rod, and the liquid substance within Porefleonrod can be percolated out of the hair brush. Porefleonrod is immersed at the vacuum state with five-gram weight of silicone (product name is X-21-7632), as the liquid substance, which is produced by Shinetsu Chemical Co., Ltd. and serves as split hair preventive.

When brushing is carried out with the hair brush having the aforesaid construction, a proper amount of split hair preventive is percolated out of holes of Porefleonrod and adhered to hair. The split hair preventive adhered to hair is uniformly coated to hair through bristles 2 during brushing. Accordingly, the liquid substance is coated to hair only through brushing with the hair brush of the present invention even though the liquid substance is not applied to hand or the bottle is not held with one hand to effect the coating to hair. Additionally, the liquid substance can be substantially uniformly coated to hair through bristles 2.

The hair brush with the above Porefleonrod immersed with silicone was used three times every day in the morning, in the afternoon and at night for about two years and silicone of split hair preventive was continued to percolate. Immersion amount of silicone to Porefleonrod can be properly selected by changing porosity and hole diameter, but has generally a porosity of about 50 to 90%. Coating amount to hair, that is, the amount of percolation from Porefleonrod, can be adjusted in response to viscosity of silicone, immersion amount and the time of brushing. Since Porefleonrod can be removably attached to the brush main body 10, in the case that immersed silicone is exhausted, it may be replaced by a spare Porefleonrod immersed with the liquid substance.

As the liquid substance, it is possible to utilize various kinds of liquid for use with hair such as ultraviolet cut-off agent, luster agent, hair dye agent, hair liquid, hair growing agent, anti-odor liquid and the like, in addition to split hair preventive.

Figure 2:
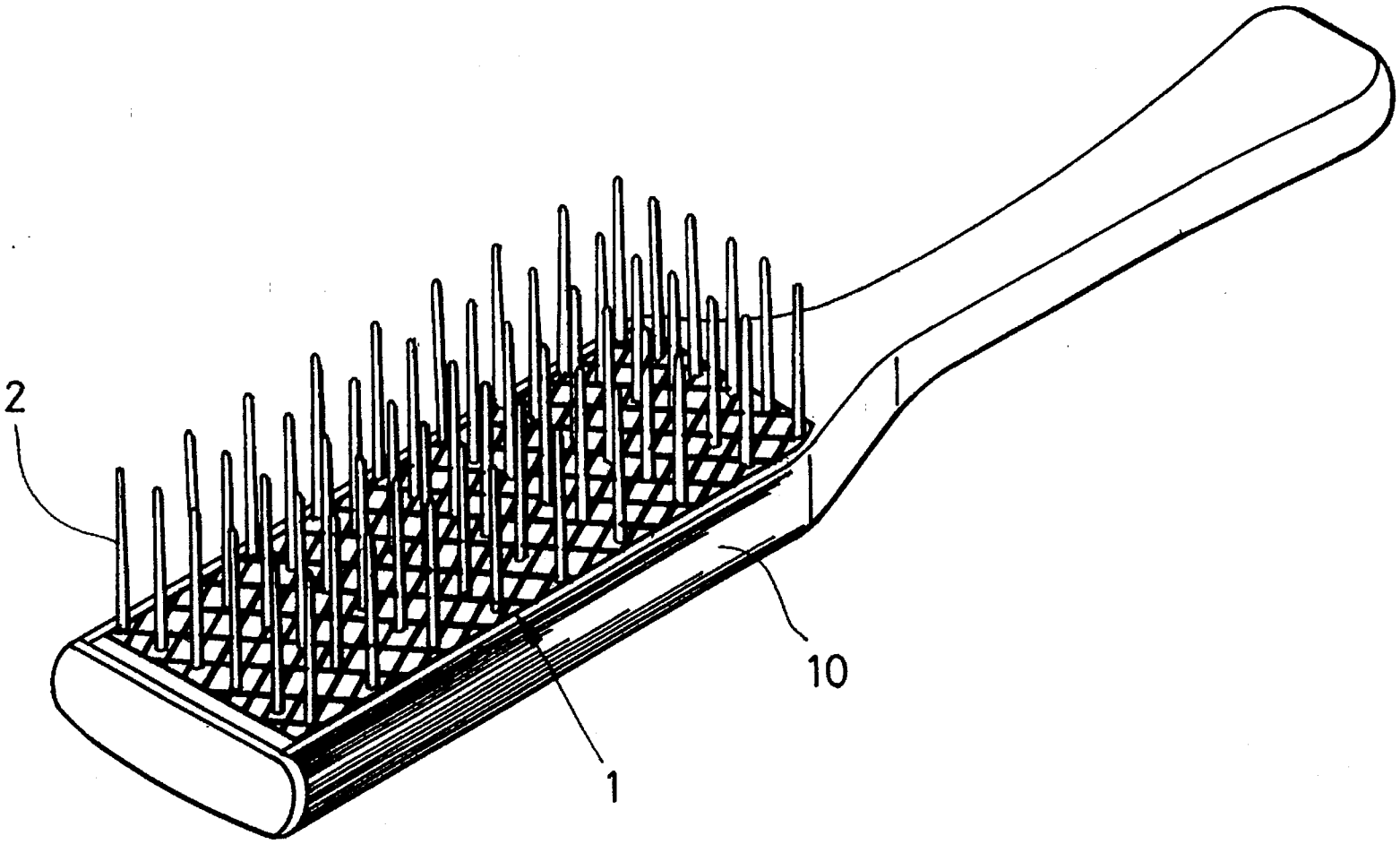
FIG. 2 is a perspective view showing a hair brush of another embodiment of the present invention.

The immersion member 1 to be used in the hair brush of the present invention is not limited to the porous member in a form of a rod such as the above-mentioned Porefleonrod. For example, the immersion member 1 attached to the hair brush shown in FIG. 2 is a net of non-woven fabric or knitted fabric of porous fibers. The net as the immersion member 1 covers the upper surface of the brush main body 10 while the liquid substance is being held in the holes of porous fibers.

Figure 3:
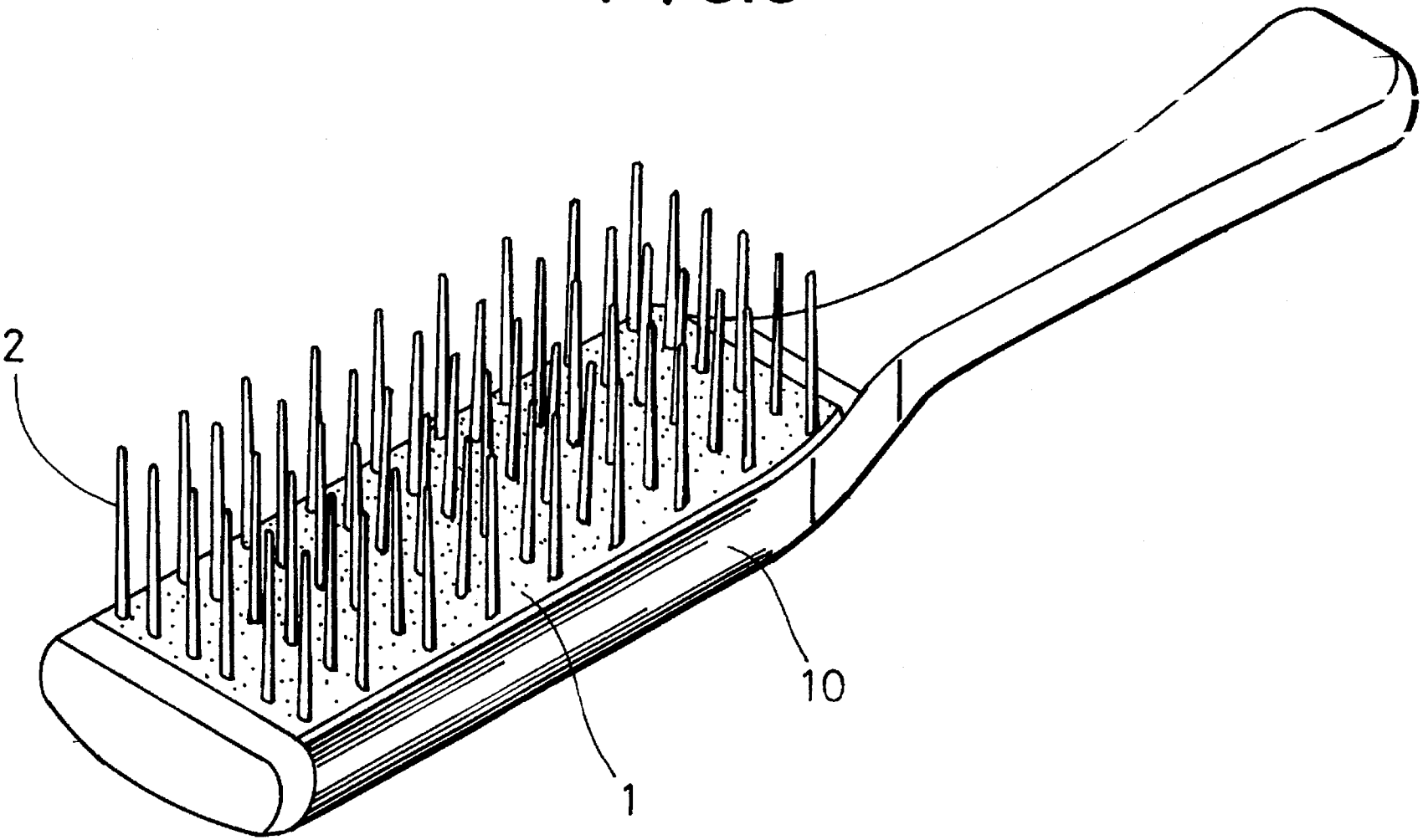
FIG. 3 is a perspective view showing a hair brush of a further embodiment of the present invention.

The impregnation member 1 attached to the hair brush shown in FIG. 3 is a plate member formed by a porous member of polytetrafluoroethylene resin or porous rubber. As the porous rubber, foamed rubber having continuous air bubbles therein, for example, and the like are used.

The plate member of the impregnation member 1 is arranged on the upper surface of the brush main body 10 overlying it while liquid substance is being kept therein. Since the impregnation member 1 is the plate member for covering the entire upper surface of the brush main body 10, it is possible to apply the liquid substance over the entire hair when a brushing is performed. In this case, the impregnation member 1 of the plate member can be replaced in the same manner as that for the rod member. Since the impregnation member 1 of the plate member has some through-holes at the locations corresponding to the bristles, if the bristles are passed through the through-holes, no positional displacement occurs between them and the impregnation member 1 can be fixed to the proper position on the upper surface of the brush main body 10.

The porous member made of polytetrafluoroethylene resin constituting the impregnation member will now be described.

The porous member made of polytetrafluorethylene resin is generally manufactured in accordance with the following method. That is, powder of polytetrafluoroethylene resin is mixed with liquid lubricant such as white oil or xylole and the like, and the mixture is extruded or rolled to form a shape and after these operations, the mixture is elongated. Then, before elongation or after elongation, liquid lubricant contained in the mixture is evaporated or extracted and removed. Many porous holes are formed by removing the liquid lubricant. Then, in order to improve the strength of the body having porous holes formed therein, the formed member is baked at a temperature higher than the melting point of polytetrafluoroethylene resin, resulting in the porous member of the present invention. The porosity and the mean hole diameter and the like can be properly adjusted by controlling the amount of liquid lubricant in the mixture and the degree of rolling reduction/elongation in the rolling step and the like.

The porous member made of polytetrafluoroethylene resin as described above has characteristics of a porous member having some continuous air bubbles therein and characteristics of polytetrafluoroethylene resin (for example, superior anti-chemicals, heat-resistance, non-adhering feature, hydrophobic characteristic and anti-oil characteristic). Accordingly, it is possible to impregnate various kinds of liquid substances, such as an anti-split hair agent, in the continuous air bubbles.

Impregnation of the liquid substance into the porous member made of polytetrafluoroethylene resin is carried out by vacuum impregnation. For example, air in the container is discharged by a vacuum pump under a condition in which the porous member with a porosity of about 50 to 90% (a plate member of 40 mm×80 mm×1.0 mm) and dimethylpolysiloxane (30 cm stokes of viscosity) acting as liquid substance, are contained in the closed container and a pressure within the container is set at about $7.5\times10^{-1}$–$7.5\times10^{-4}$ Torr, resulting in that the liquid substance is impregnated into the porous member by about 1.3–1.8 ml.

The liquid substance impregnated into the porous member is percolated little by little in response to the hydrophobic characteristics and anti-oil characteristics of polytetrafluoroethylene resin. Even if the liquid substance percolated out at the surface by brushing operation is consumed, the liquid substance impregnated in the porous member is percolated out to the surface in response to the hydrophobic characteristics and anti-oil characteristics of polytetrafluoroethylene resin, so that it is possible to continue to supply the liquid substance for a long period of time. In turn, since the hole diameter of the impregnation member is fine in its size and the polytetrafluoroethylene is not compressible in the manner of a sponge, almost all of liquid substance impregnated into the impregnation member cannot flow out at once despite a certain pressing force being applied as would occur with a normal sponge and the like. Thus, the impregnation member made of a porous polytetrafluoroethylene resin can be impregnated with various kinds of liquid substances in response to its object and then the liquid substance can be stably supplied for a long period of time in a proper amount under a normal state of use.

What we claim is:

1. A hair brush comprising a brush main body, bristles vertically extending from an upper surface of said brush main body and an impregnation member provided on said upper surface of said brush main body, said impregnation member being impregnated with a liquid substance to be coated to hair; wherein said impregnation member is a porous body made of polytetrafluoroethylene.

2. A hair brush according to claim 1 in which the impregnation member is a porous member in a form of a rod.

3. A hair brush according to claim 2 in which a recess is provided on a central portion of the upper surface of the brush main body and the impregnation member is formed as a rod removably received in said recess.

4. A hair brush according to claim 3 in which the impregnation member is replaceable.

5. A hair brush according to claim 2 in which the impregnation member is replaceable.

6. A hair brush according to claim 1 in which the impregnation member is a net formed by fabric of porous fibers and said net covers said upper surface of the brush main body.

7. A hair brush according to claim 6 in which the impregnation member is replaceable.

8. A hair brush according to claim 1 in which the impregnation member is replaceable.

9. A hair brush according to claim 1, in which the impregnation member has a plate-shaped body and the upper surface of the brush main body is covered by said plate-shaped body.

10. A hair brush according to claim 9 in which the impregnation member is replaceable.

11. A hair brush according to any one of claims 8, 10, 1, and 9 in which the porosity of the impregnation member is about 50 to 90%.

12. A hair brush according to claim 11, in which the impregnation member is a porous member having a continuous air bubbles.

13. A hair brush according to claim 11 in which a liquid substance impregnated in the impregnation member percolates out of a surface of the impregnation member with the elapse of time.

14. A hair brush according to any one of claims 8, 10, 1, and 9, in which the impregnation member has continuous air bubbles.

15. A hair brush according to claim 14 in which a liquid substance impregnated in the impregnation member percolates out of a surface of the impregnation member with the elapse of time.

16. A hair brush according to any one of claims 8, 10, 1, and 9, in which the liquid substance has been vacuum impregnated into the impregnation member.

17. A hair brush according to claim 16 in which a liquid substance impregnated in the impregnation member percolates out of a surface of the impregnation member with the elapse of time.

18. A hair brush according to any one of claims 8, 10, 1, and 9, in which a liquid substance impregnated in the impregnation member percolates out of a surface of the impregnation member with the elapse of time.

* * * * *